US010364123B2

(12) United States Patent
Potts

(10) Patent No.: US 10,364,123 B2
(45) Date of Patent: Jul. 30, 2019

(54) CABLE-CORD WRAPPING APPARATUS

(71) Applicant: Douglas Potts, Dallas, TX (US)

(72) Inventor: Douglas Potts, Dallas, TX (US)

( * ) Notice: Subject to any disclaimer, the term of this patent is extended or adjusted under 35 U.S.C. 154(b) by 0 days.

(21) Appl. No.: 15/914,201

(22) Filed: Mar. 7, 2018

(65) Prior Publication Data

US 2018/0257901 A1 Sep. 13, 2018

Related U.S. Application Data

(60) Provisional application No. 62/468,238, filed on Mar. 7, 2017.

(51) Int. Cl.
*B65H 49/20* (2006.01)
*B65H 54/72* (2006.01)
*B65H 75/36* (2006.01)

(52) U.S. Cl.
CPC ..... *B65H 49/205* (2013.01); *B65H 54/72* (2013.01); *B65H 75/366* (2013.01); *B65H 2701/34* (2013.01)

(58) Field of Classification Search
CPC .... B65H 49/205; B65H 75/06; B65H 75/366; B65H 54/72; B65H 2402/412; B65H 2701/34
See application file for complete search history.

(56) References Cited

U.S. PATENT DOCUMENTS 2,709,028 A * 5/1955 Cottar ..... B65H 75/366 242/405.2
4,688,739 A * 8/1987 Moore ..... B65H 75/06 242/405.2
4,779,815 A * 10/1988 Moore ..... B65H 75/366 242/405.1
5,181,757 A * 1/1993 Montoya ..... A45F 5/1026 294/159
5,429,321 A * 7/1995 Skyba ..... B65H 75/366 242/405.2
5,667,266 A * 9/1997 Giocanti ..... A45F 5/1026 294/159
6,003,803 A * 12/1999 Knapp ..... B65H 75/366 242/388
6,135,381 A * 10/2000 Teson ..... B65H 75/06 242/404.3
6,499,199 B2 * 12/2002 Frazier ..... B65H 75/366 24/30.5 R
7,017,295 B2 * 3/2006 Hacker ..... A01K 97/14 43/5
7,350,737 B2 * 4/2008 Hutchinson ..... B62B 1/14 242/405

* cited by examiner

*Primary Examiner* — William A. Rivera

(57) ABSTRACT

A cable-cord wrapping apparatus for promoting optimal wrapping and storage of audio or video cables. The cable-cord wrapping apparatus may primarily feature a handle integrally-connected to two arms running parallel to each other and integrally-connected to each other by a curved base. The arms create a channel within which to insert a cable or cord. Each arm may be tapered to provide optimal flexibility of the arms while maintaining desired structural integrity for securely storing a cable. Additionally, each arm may feature rounded ends which ease insertion of a cable or cord into the channel while also creating a barrier at the open end of the channel.

4 Claims, 10 Drawing Sheets

CABLE-CORD WRAPPING APPARATUS

CROSS-REFERENCE TO RELATED APPLICATIONS

This application claims the benefit of U.S. Provisional Application No. 62/468,238, filed on Mar. 7, 2017.

TECHNICAL FIELD

The present apparatus relates generally to electrical, video, and audio equipment; and, in particular, to cables and cords.

RELEVANT PATENT PRIOR ART REFERENCES

| | | |
|---|---|---|
| 6135381 | October 2000 | Teson |
| D330323 | October 1992 | Hu |
| 1784064 | December 1930 | Griswold |
| 2204939 | June 1940 | Lyons |
| 2490279 | Decetnber 1949 | Nunamaker |
| 4688739 | August 1987 | Moore |
| 4778125 | October 1988 | Hu |
| 4997997 | March 1991 | Moore |
| 5429321 | July 1995 | Skyba |
| 5957401 | September 1999 | O'Donnell |
| 6003803 | December 1999 | Knapp et al. |

BACKGROUND

Adequate cables are a vital component of the audio and video industry in order to quickly and successfully transmit audio and video signals over a long distance. However, even the most well-built cables risk loss of functions or complete destruction if not properly maintained. Accordingly, audio and video cables must be kept in good condition in order to operate successfully as desired.

Unfortunately, most users are not aware of how to properly maintain, wrap, and store an audio or video cable. Most commonly, users either try to loop cables or simply do nothing at all when a cable is not in use. However, improper maintenance, wrapping, and storage leads to cable disrepair; which, in turn, causes substandard cable operation.

The most commonly-used method for looping audio and video cables is known as the "over-under" method, as this method helps to prevent cable twisting. While the over-under method provides many benefits, cables looped utilizing this method remain susceptible to knotting and uncoiling due to the potential for each end of the cable to move from its respective proper side of the roll. Known methods of cable storage, such as hook-and-loop or other cable ties, have tried to prevent the ends of cables from passing through the loops by simply tightly binding the looped cable. However, these methods have proved fruitless as the ends of the wrapped cable are not prevented from passing through the loops, leading to knots and twisting when the cable is uncoiled. To date, no known apparatus exists which completely prevents the ends of a wrapped cable from passing through the loops created by the cable.

SUMMARY

In accordance with the invention, the undesirable knotting and twisting of a cable or cord is prevented by utilizing an apparatus that perfectly loops the cable or cord, keeping the ends from passing through the loops. Such an apparatus promotes audio and video cable longevity by providing a fool-proof method of cable looping and storage. In addition to providing for a fool-proof method of cable wrapping and storage, such a cable-wrapping apparatus also promotes a cleaner audio or video setup as all or part of the cable can remain secured within the apparatus while in use.

Correctly wrapping an audio or video cable or other cord can be accomplished through a handheld apparatus which features a channel into which a cable can be inserted and held in place. In a particular embodiment of the invention, a user wrapping a cable can hold the apparatus in one hand and begin wrapping the cable and simultaneously pressing the cable into the channel at the apex of each new loop. This process may be repeated until the cable has been completely wrapped, resulting in a cable forming an outwardly-spiraling loop with each new cable loop perfectly positioned on top of the preceding loop. In a particular embodiment of the present invention, each loop of the cable may be held in place by the two walls of the channel forming barriers on the sides of the cable and the preceding and succeeding cable loops forming barriers on the top and bottom of the cable. Accordingly, in a particular embodiment of the present invention, the apparatus prevents the cable from undesired unwinding, keeps the cable loops together and prevents the ends of the wound cable from crossing and creating knots. In an additional particular embodiment of the present invention, the apparatus may feature a hook, hole, or other means for hanging the apparatus and cable on the wall, promoting easy storage of a wrapped cable or cord.

The cable-cord wrapping apparatus can be made from any desired material. However, particular embodiments of the present invention may advantageously use hard plastic as the primary material for the cable-wrapping apparatus to reduce weight and lower cost. Moreover, the cable-cord wrapping apparatus can also be used with any type of cable or cord—such as an electrical cable—in addition to audio and video cables.

While Knapp, U.S. Pat. No. 6,003,803, has elements of the present invention, Knapp is insufficient to contain a cord or cable in a manner that prevents unintentional winding and fails to teach any form of cord or cable tensioning or cord or cable channel restriction to optimally secure a cord or cable, as more fully described below; therefore, Knapp does not and cannot anticipate the present invention.

BRIEF DESCRIPTION OF THE DRAWINGS

FIG. 2, Label 1, is the lower operative bracket capable of providing a modicum of tension against at least the first rung of a loop on a cable or cord inserted into the channel. The lower bracket attached or formed to the main post of the present invention;

FIG. 2, Label 2, is the second upper operative bracket capable of operatively flexing to allow a cable or cord inserted into the channel to pass through and then close behind the passing cable or cord. An open space behind this second upper bracket allows space for the bracket to flex for allowing a cable or cord to enter and exit the channel. The second upper bracket attached to the top of the retention arm;

FIG. 2, Label 3, is the first upper operative bracket capable of operatively flexing to allow a cable or cord inserted into the channel to pass through and then close behind the passing cable or cord. An open space behind this first upper bracket allows space for the bracket to flex for allowing a cable or cord to enter and exit the channel, and both the first and second upper brackets relatively abut to narrow cable channel to prevent a cable from escaping without a modicum of force. The first upper bracket attached to the top of the main post of the present invention and forming a part of the handle;

FIG. 2, Label 4, is the narrowing point where the first upper operative bracket and the second upper operative bracket abut thereby narrowing the channel and preventing a cable or cord loop from escaping without a modicum of force;

FIG. 2, Label 5, is the elongated handle for resting on the user's hand, a rack, a belt loop or other similar resting space;

FIG. 2, Label 6, is the open space of handle where the user's hand or fingers would be placed or the present invention could be hung on a rack, a belt loop or other similar resting space.

FIG. 2, Label 7, is the bottom of the channel where the first rung of a cable or cord loop would be placed;

FIG. 2, Label 8, is the open space behind the lower bracket found in FIG. 2, Label 1, allowing the lower bracket to flex;

FIG. 2. Label 9, is a depressed surface on the body of the device capable of receiving a label;

FIG. 2, Label 10, is a depressed surface on the body of the device capable of receiving a label;

FIG. 2, Label 11, is the channel from which cable or cord is inserted into or removed from.

SPECIFICATION

As noted above, proper maintenance of audio and video cords or cables is paramount to the successful operation of such cables. Known methods of cord or cable maintenance include wrapping and binding a cord or cable with hook-and-loop fasteners or ties. However, these methods do not prevent the cords or cables from getting twisted or otherwise from allowing either end of a cord or cable from passing through a cord or cable loop and creating knots. Currently, no known methods exist to properly maintain a wrapped cable or cord by keeping the loops of the cable or cord from overlapping and keeping the ends of the cable or cord from passing through the center of the loops.

Figure 1:
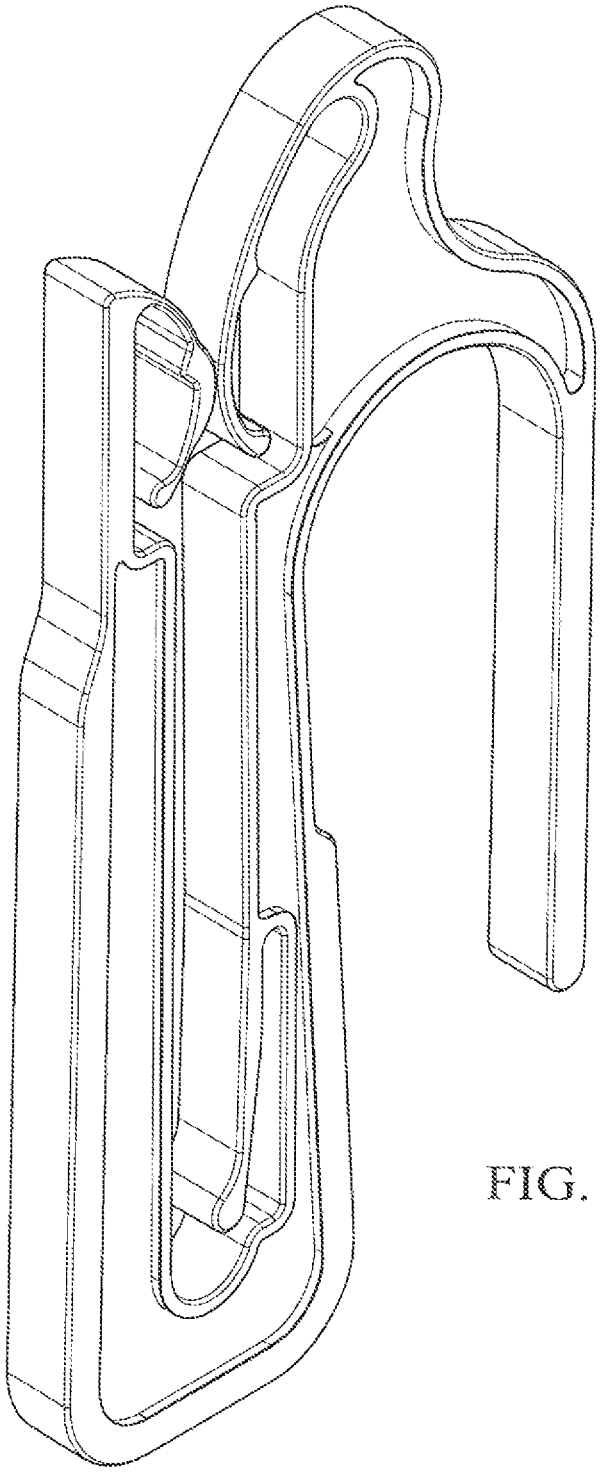
FIG. 1 is a side view of a cable-cord wrapping apparatus embodying the principles of the present invention.
Figure 2:
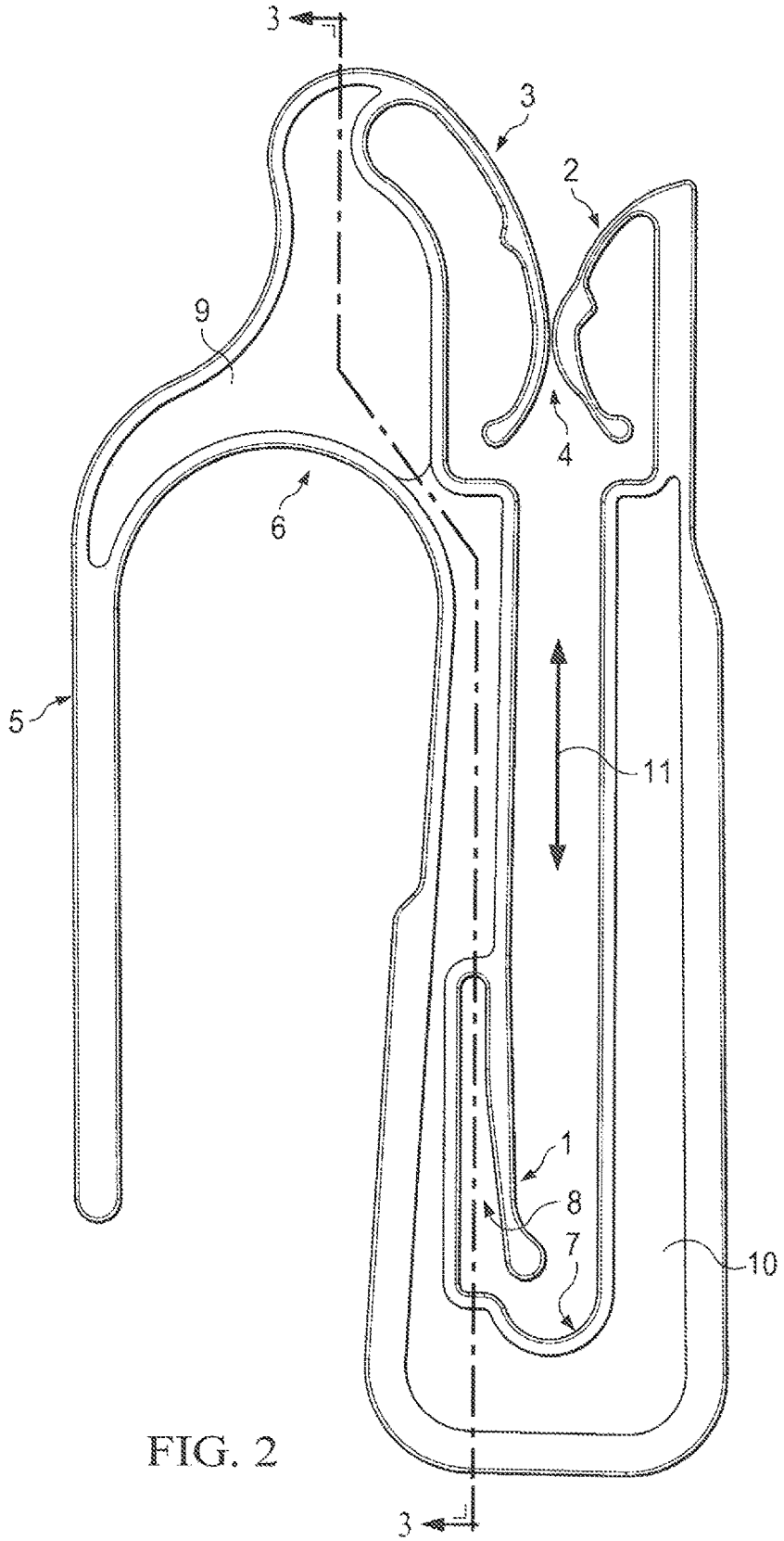
FIG. 2 is a flat view of a cable-cord wrapping apparatus embodying the principles of the present invention.
Figure 3:
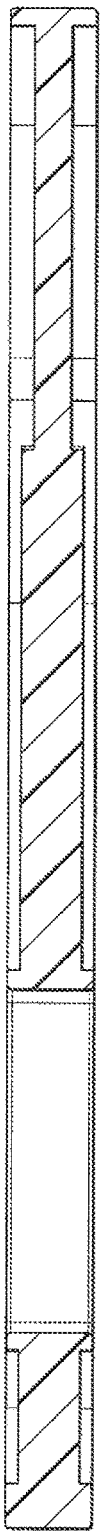
FIG. 3 is a cross-sectional view of a cable-cord wrapping apparatus embodying the principles of the present invention.
Figure 4:
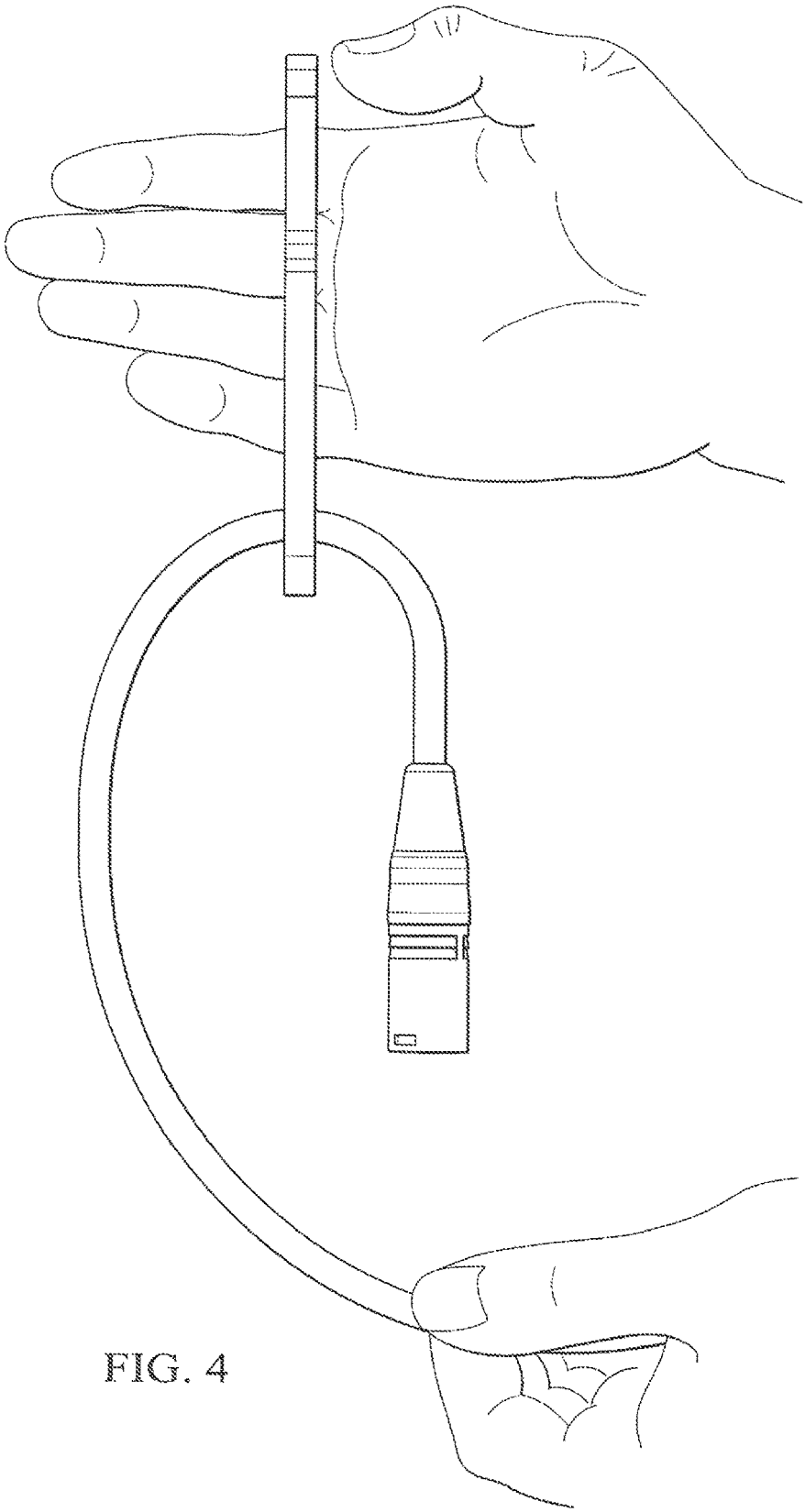
FIG. 4 is side view of a cable-cord wrapping apparatus showing placement on a hand and the first rung of a loop into the present invention.

FIGS. 1 and 2 depict a cable-wrapping apparatus embodying the principles of the present invention. Particularly, FIG. 1 depicts a side view of a cable-cord wrapping apparatus embodying the principles of the present invention while FIG. 2 depict a flat view of a cable-wrapping apparatus embodying the principles of the present invention. FIG. 3 is a cross-sectional view of the device as denoted on FIG. 2 via a cross-sectional line depicted as 3 with an arrow of FIG. 2. In a particular embodiment of the present invention, the cable-wrapping apparatus may be generally comprised of one solid piece of material which features a handle integrally-connected to a clip-like, channel portion of the apparatus comprised of two arms connected at a base.

As described above, the clip-like, channel portion of an apparatus embodying the principles of the present invention may be generally comprised of two arms extending upward from a base which acts as both a curved base and channel wall to prevent cables from falling out of the apparatus. In a particular embodiment, each arm extending from the base may be tapered, wherein the cross-section of each arm is thicker near the base of the apparatus than it is near the top, or alternate end, of the apparatus. Such tapers allows for flexibility of the channel arms near the top of the apparatus—allowing for easy insertion of a cord or cable into the channel—while promoting rigidity near the base of the apparatus, which prevents the channel arms from separating from one another under the weight of a cable. Additionally, in a particular embodiment, the opposing faces of each channel arm are rounded at the top opening of the channel to create a clip-like mechanism that holds a cord or cable in place once inserted into the channel. In addition to creating a barrier when a cord or cable is inserted into the channel, the opposing rounded faces of each channel arm serve a dual purpose of allowing for easier insertion of a cord or cable into the channel as the rounded face creates a wider opening at the top of the apparatus which sufficiently guides a cord or cable into the center of the channel during insertion. If desired, one channel arm may be longer than the other to promote quicker cord or cable insertion by acting as a backstop during cord or cable insertion, thereby allowing for more variation in cord or cable insertion points.

In a particular embodiment of the present invention, the interior of the channel is generally comprised of the face of the apparatus base and the two opposing faces of the two channel arms. If desired within the channel, the opposing faces of channel arms may feature one or more small protrusions on each opposing face of the channel arms to further secure a cord or cable within the apparatus.

If desired, the cable-wrapping apparatus may also feature a more clip-like structure, wherein the base of the apparatus operates as a living hinge for the channel arms (a/k/a the first and second upper tension brackets). In such an embodiment, one channel arm may feature grooves along a face of the arm for the insertion of a length of cord or cable. The other channel arm of such an embodiment acts as a gate wherein the two channel arms may feature corresponding components of a clip, snap, or other enclosure method which allows the gate arm to be secured to the corresponding channel arm when closed.

Figure 5:
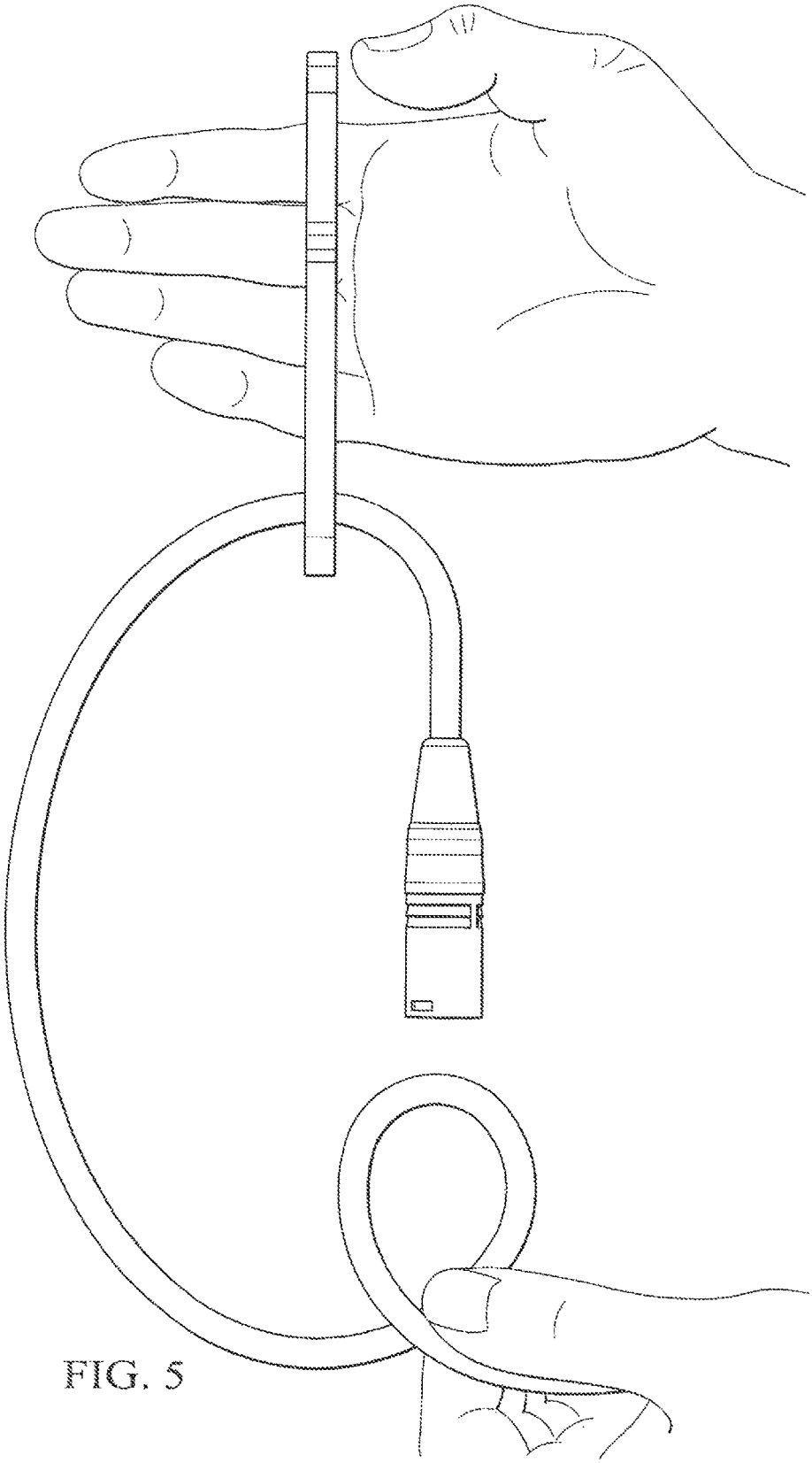
FIG. 5, FIG. 6, FIG. 7.
Figure 6:
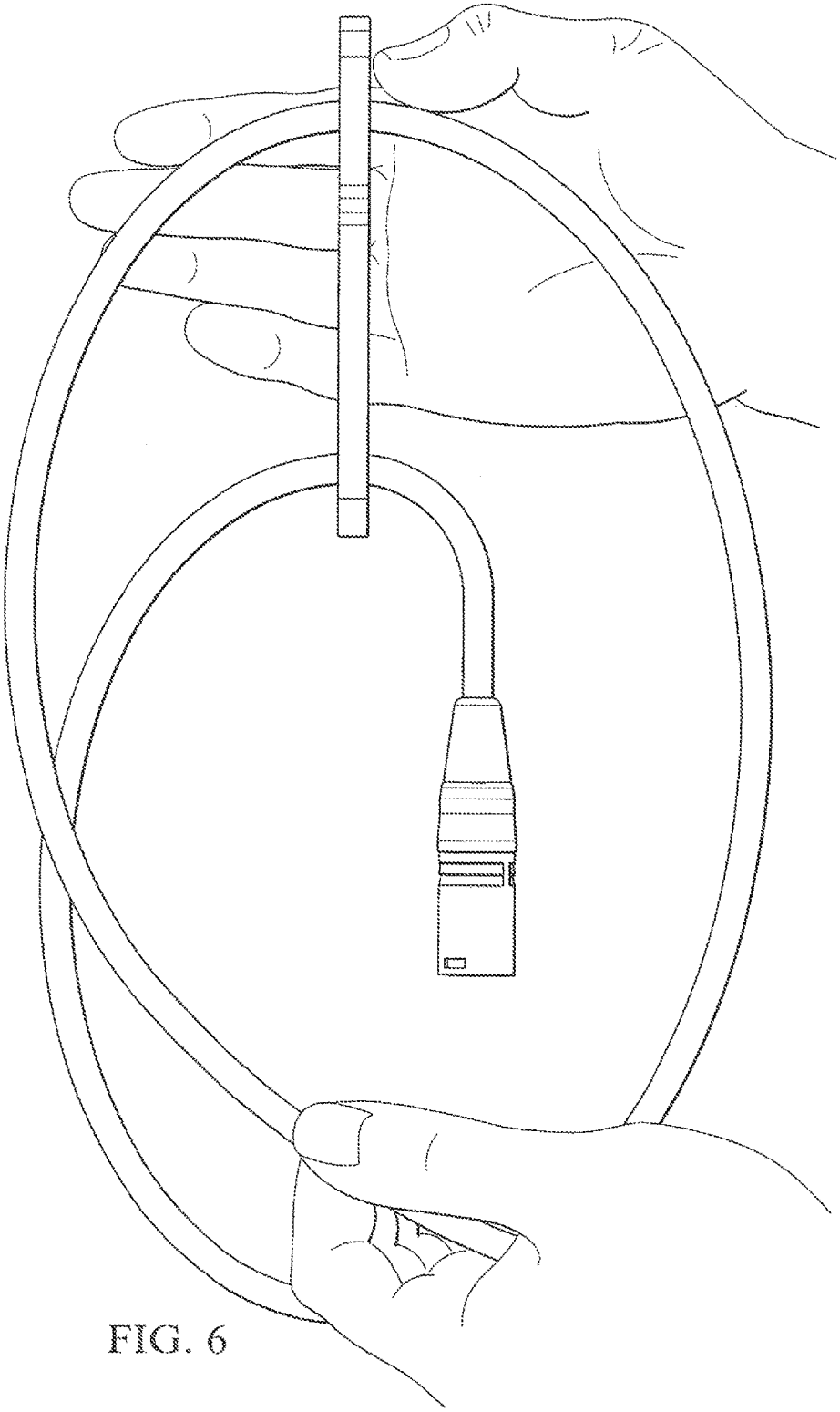
Figure 7:
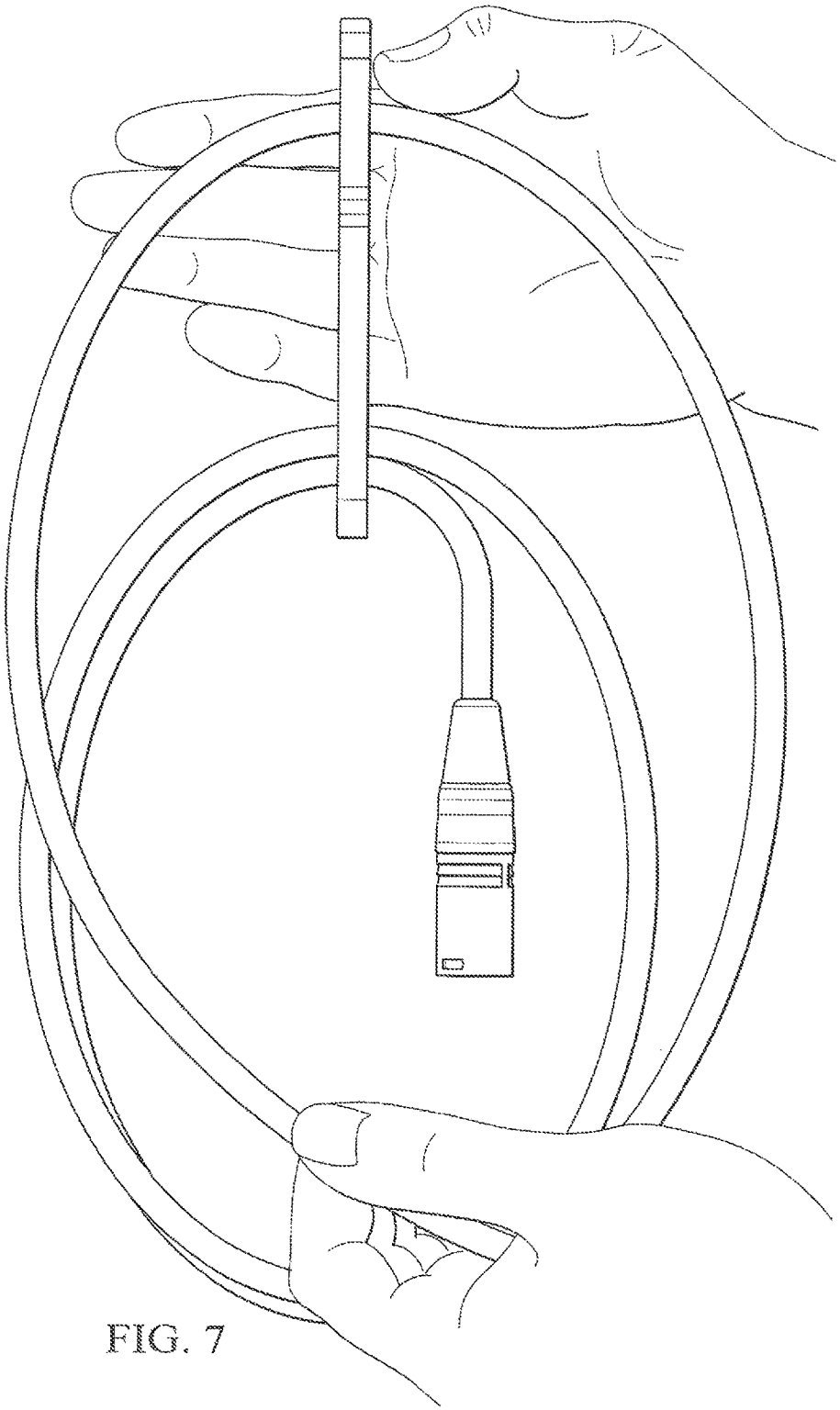
Figure 8:
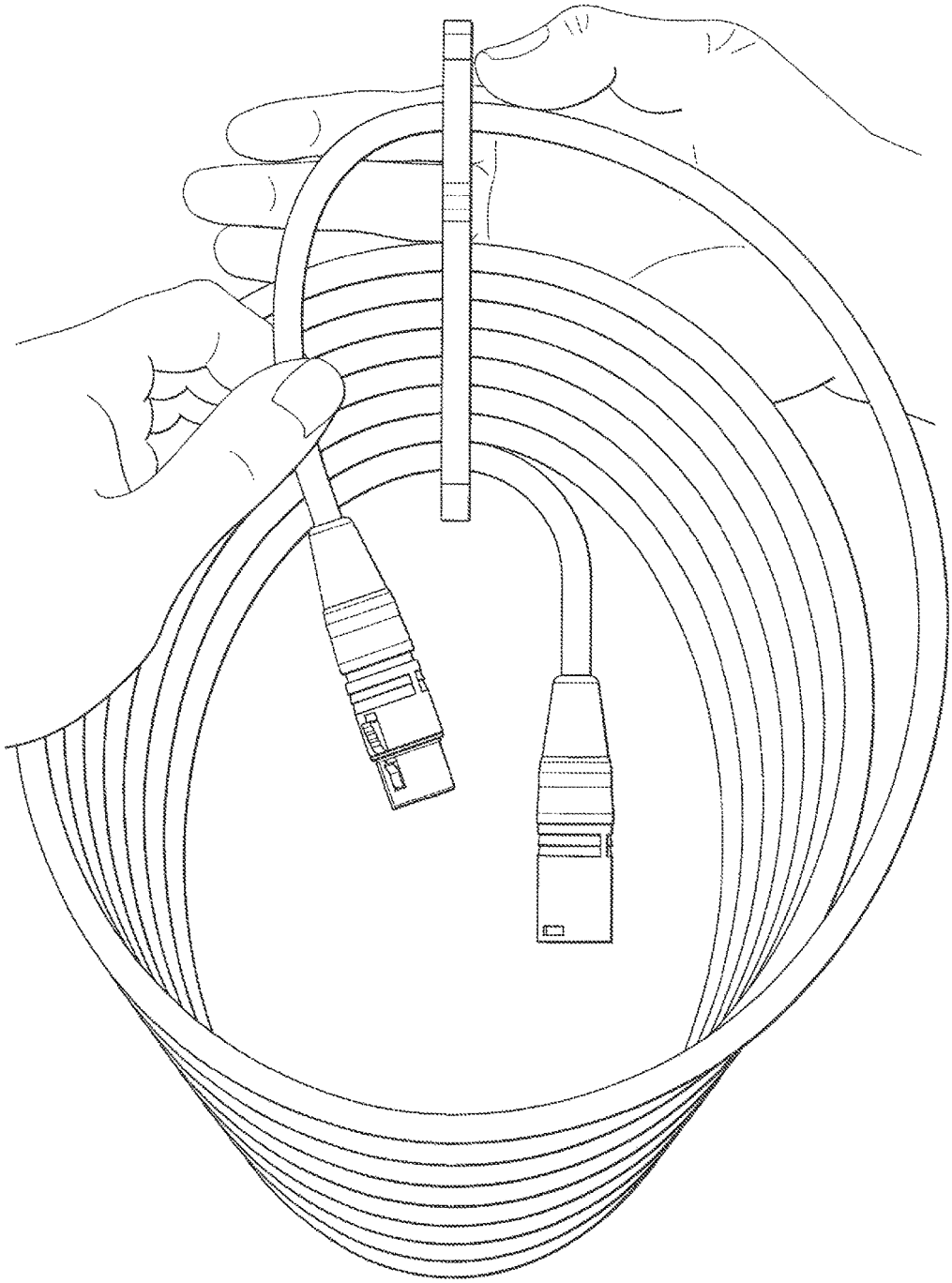
FIG. 8, and FIG. 9 are side views of a cable-wrapping apparatus showing device placement on a hand, each with varying stages of cable or cord loops inserted into the present invention.
Figure 9:
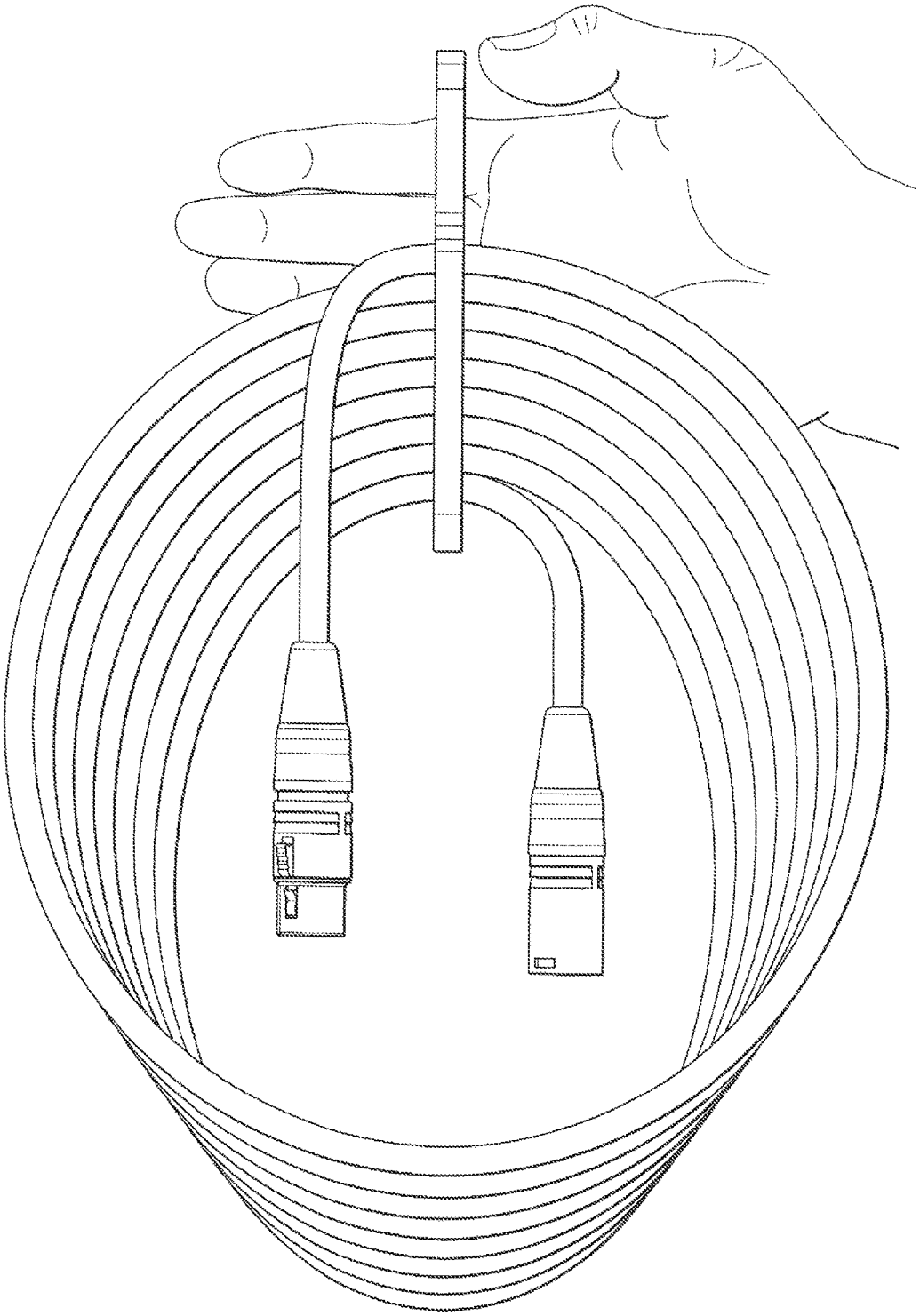

Particularly, the present invention contains an elongated handle for sitting on a hand or fingers when the palm is turned vertical relative to the body (See FIG. 2, label 5; See FIG. 5), thus allowing the cord or cable to be wrapped using the other hand (See FIG. 7; See FIG. 8.) without significant movement of the invention. The present invention further has opposing first and second upper tension brackets (See FIG. 2, labels 2 and 3 respectively) which abut each other (See FIG. 2, label 4) at the top the cord or cable channel (See FIG. 2, label 11) which prevent the cord from escaping when wound into the device. Such tension brackets operatively flex to allow the cable to slip into the cable channel; however, such tension brackets quickly close back into place to narrow the cable channel (See FIG. 2, label 4) such that the cord or cable cannot readily escape without additional force from the user. Likewise, the tension brackets are curved at the bottom of each tension bracket (See FIG. 2, label 4) to allow the cord or cable to escape the channel when a modicum of force is applied by the user to remove said cord or cable from the channel. The open spaces behind each upper tension bracket allow the brackets to operatively flex open when required and then return to a substantially closed state when a cord or cable is not passing through the channel.

Similarly, a lower tension bracket attached or formed to the main post intrudes into the channel space (See FIG. 2, label 1) which flexes as at least one lower rung of the cord or cable is placed into the channel such that the lower tension bracket applies a force to the first lower rungs thereby aiding in securing the initial rungs of a cord or cable at the bottom of the channel. The first rung of the cord or cable rests at the bottom of the channel (See FIG. 2, label 7.) The open space behind the lower tension bracket (See FIG. 2, label 8) allows the lower bracket to operatively flex to provide a force when at least one rung of a cord or cable is placed into the channel bottom.

Figure 10:
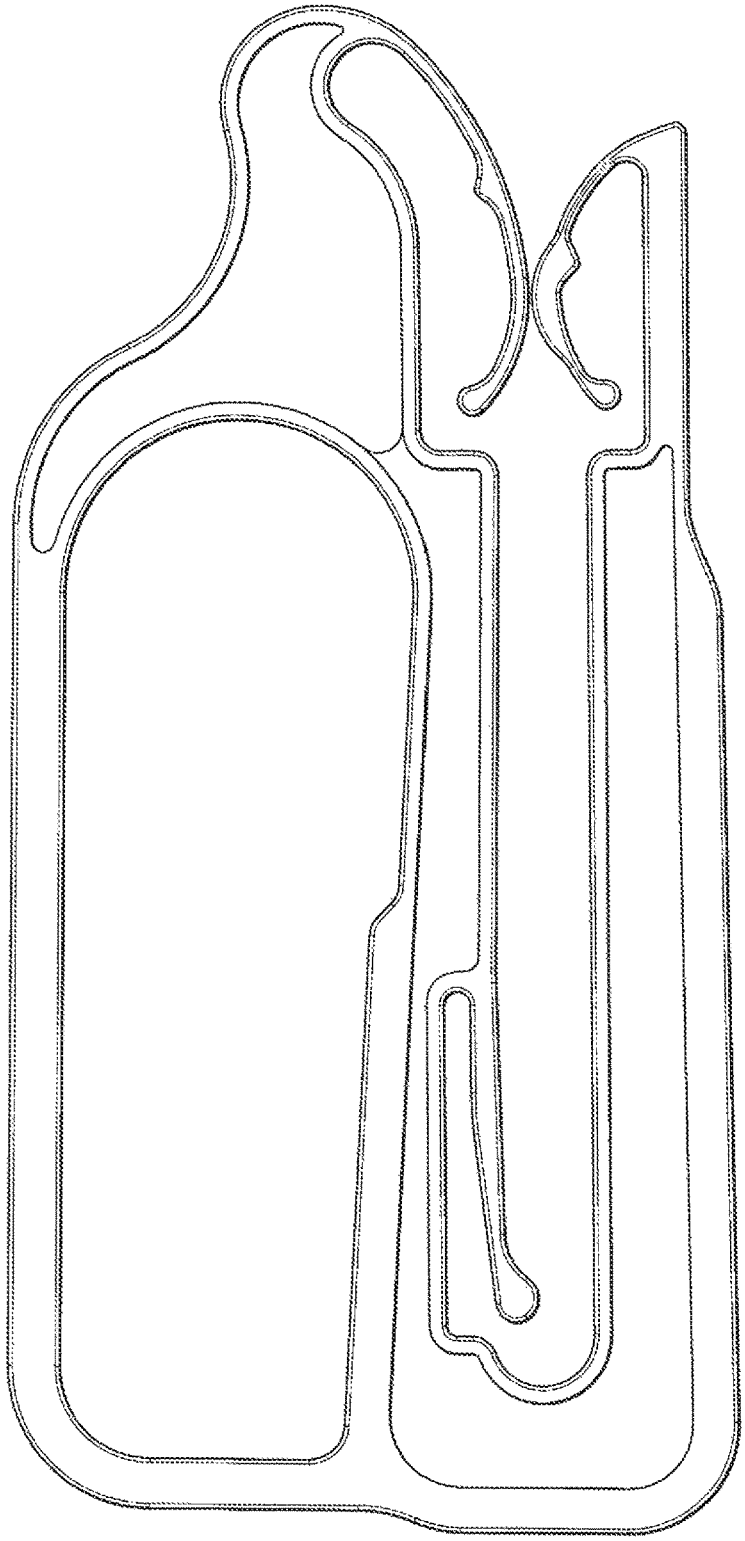
FIG. 10, is a side view of a cable-cord wrapping apparatus showing a closed handle (i.e. a handle completely closed at the bottom and connected to the main post).

Optionally, the present invention contains an elongated handle closed and connected to the main post (See FIG. 10) for storing in boxes, bags, closets or the like. The closed handle configuration would prevent other cables from being entangled on the present invention when stored in a manner other than hanging the device on an object. In this closed handle configuration, the fingers are still able to be utilized to stabilize the device when wrapping a cord or cable.

Optionally, the present invention can contain depressed areas on its surface (See FIG. 2, labels 9 and 10) such that labels can be affixed for identifying the particular type of cable.

The foregoing merely illustrates the principles of the present invention. Therefore, it will be appreciated that those skilled in the an will be able to devise numerous alternative arrangements that, while not shown or described herein, embody the principles of the invention and thus are within the spirit and scope of the invention.

I claim:

1. A cable or cord holder, comprising:

a handle being generally vertically aligned for gripping;

a main post having top and bottom ends, a length and a width, the length of said main post being connected to said handle at the top end and extending generally downwardly therefrom along its length;

a retention arm having top and bottom ends extending upwardly from the bottom end of said main post to define said retention arm opening slot, such opening slot having a length and a width, the length extending substantially parallel relative to the generally vertical extending handle, and said retention arm opening slot shaped for receiving a plurality of loops of a cord or cable;

a first upper tension bracket operatively connected to said main post top and forming a part of said handle; and wherein said retention arm top contains a second upper tension bracket operatively connected to said retention arm top such that said first upper tension bracket and said second upper tension bracket operatively narrow the width of said retention arm opening slot; and a lower tension bracket operatively connected adjacent said main post such that said lower tension bracket narrows the bottom portion of said retention arm opening slot causing at least one rung of a loop of cord or cable to be tensioned in place in said retention arm opening slot.

2. The cable or cord holder of claim 1 wherein said retention arm opening slot converge toward the bottom end of said main post.

3. The cable or cord holder of claim 1 wherein said cord holder is a one-piece integrally formed member.

4. The cable or cord holder of claim 1 wherein said cord holder contains depression areas on said formed member capable of receiving identification labels for marking said cable or cord holder.

* * * * *